United States Patent [19]

Dürr et al.

[11] 4,350,450

[45] Sep. 21, 1982

[54] STYLUS PRINTING HEAD COMPRISING ELECTROMAGNETS ON RESILIENT SUPPORTS

[75] Inventors: Heinrich Dürr, Wilnsdorf; Hermann Richter, Freudenberg; Wendelin Weber; Burkhard Goerke, both of Siegen; Peter Engler, Wilnsdorf, all of Fed. Rep. of Germany

[73] Assignee: U.S. Philips Corporation, New York, N.Y.

[21] Appl. No.: 189,970

[22] Filed: Sep. 22, 1980

[30] Foreign Application Priority Data

Oct. 2, 1979 [DE] Fed. Rep. of Germany ..... 2939885

[51] Int. Cl.[3] ..... B41J 3/12

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 3,897,865 | 8/1975 | Darwin et al. | 400/124 |
| 4,004,671 | 1/1977 | Kondur | 400/124 |
| 4,218,150 | 8/1980 | Swaim | 400/124 |

*Primary Examiner*—Paul T. Sewell

*Attorney, Agent, or Firm*—Robert S. Smith

[57] ABSTRACT

A stylus printing head comprising a number of electromagnets which operate the printing styli and which are clamped on a conical carrier by means of a clamping device. The carrier comprises cradle-shaped, resilient supports for each of the electromagnets. The resilient supports compensate for differences in expansion of the electromagnets, the carrier and the clamping device in reaction to temperature variations occurring. The resilience of the supports is obtained by means of slots in the carrier which enable the use of a plurality of carriers in the same printing head.

4 Claims, 5 Drawing Figures

STYLUS PRINTING HEAD COMPRISING ELECTROMAGNETS ON RESILIENT SUPPORTS

Figure 1:
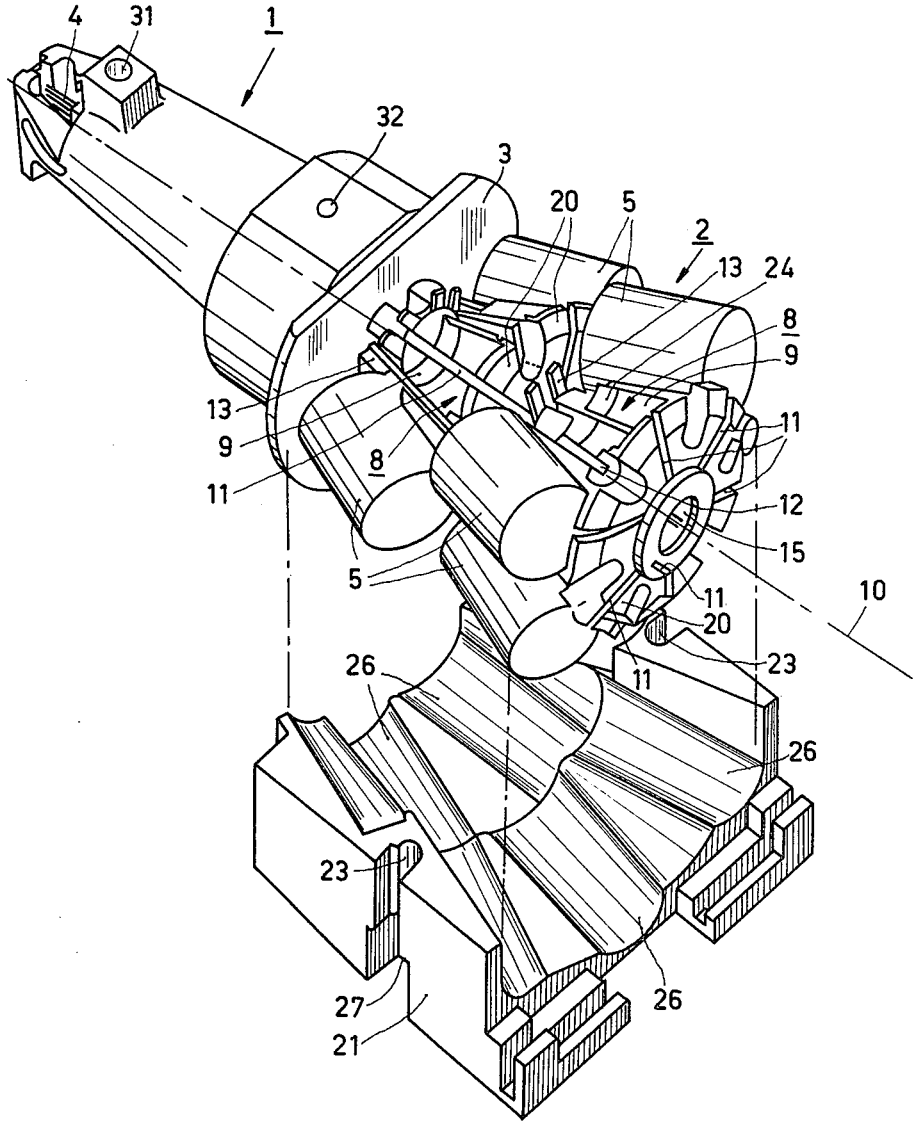

The invention relates to a stylus printing head, comprising cylindrical electromagnets which are circularly arranged around a central axis and which operate the printing styli, said electromagnets being accommodated in cradle-shaped supports of at least one conical carrier.

In a known stylus printing head of the kind set forth in the magazine "Electronics", dated Mar. 3, 1977, page 54, the electromagnets are clamped in metal, cradle-shaped supports by means of bolts which are screwed into the conical carrier. The electromagnets are clamped between the wall of the cradle-shaped support and the lower side of the bolt head.

It is a drawback of the known stylus printing head that the connection by means of a bolt is not reliable in all circumstances. This is notably so because of the vibrations often occurring in stylus printing heads and also because of the substantial temperature variations always occurring. Temperature variations lead to a difference in expansion of the electromagnet, the conical carrier and the clamping bolt, which can not be sufficiently compensated for in view of the described rigid connection.

The invention has for its object to provide a stylus printing head in which the said drawback is avoided.

To this end, a stylus printing head in accordance with the invention is characterized in that the cradle-shaped supports are resilient, the electromagnets being mounted under spring force in the cradle-shaped supports by means of a clamping device which is common to all electromagnets mounted on the carrier, each electromagnet is locked against sliding in its longitudinal direction by way of two protrusions, at least one of which is flexible.

Thanks to the fact that the electromagnets in a stylus printing head in accordance with the invention are clamped between two bodies, at least one of which bears against the electromagnet under spring force, vibrations and temperature variations can at the most cause a reduction of the clamping force, but never the loosening of the electromagnets or damaging of the printing head due to insufficient compensation of differences in expansion.

A special embodiment of a printing head in accordance with the invention offers the advantage that the electromagnets can bear against the cradle-shaped supports over a comparatively large surface area, the carrier also being suitable for use in printing heads comprising a plurality of such carriers which are arranged one behind the other. This printing head is characterized in that the carrier is made of a synthetic material, each of the cradle-shaped supports being divided by a slot which extends in the longitudinal direction of the relevant electromagnet, further slots which extend in the longitudinal direction of the electromagnets being provided between the cradle-shaped supports of adjacently arranged electromagnets.

In a further embodiment in accordance with the invention, more rigid synthetic materials can be used for the carrier, while maintaining adequate resilience of the cradle-shaped supports, because at the area of each of the electromagnets the carrier comprises an undercut which extends in the longitudinal direction of the electromagnets.

The invention will be described in detail hereinafter with reference to the accompanying diagrammatic drawing.

Figure 2:
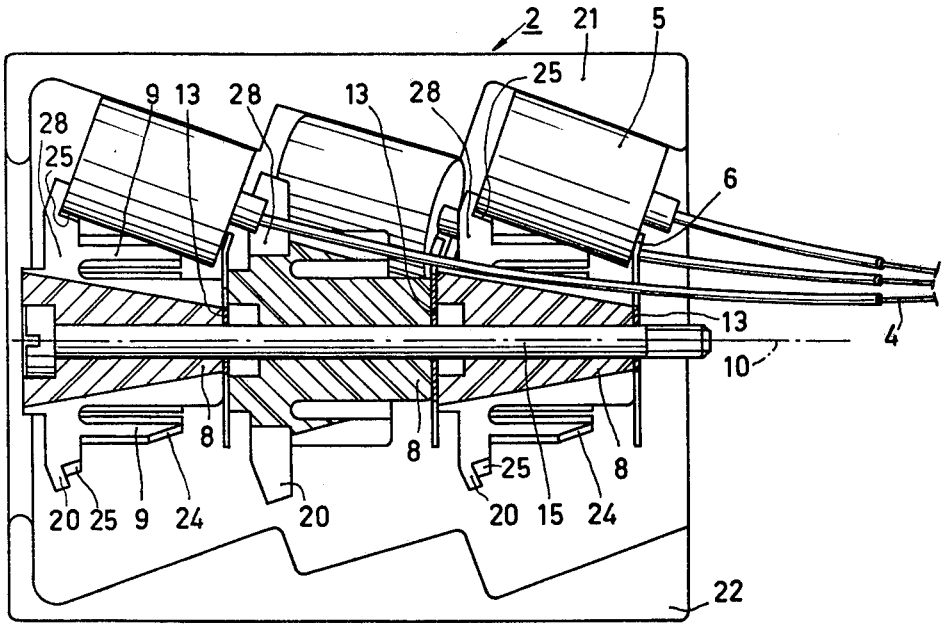
Figure 3:
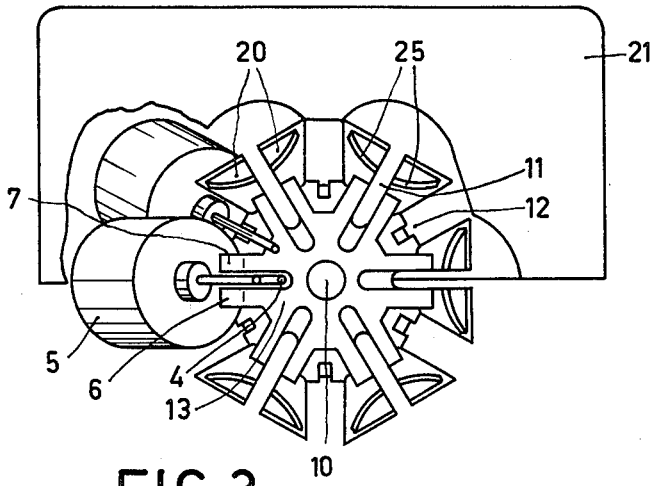
Figure 4:
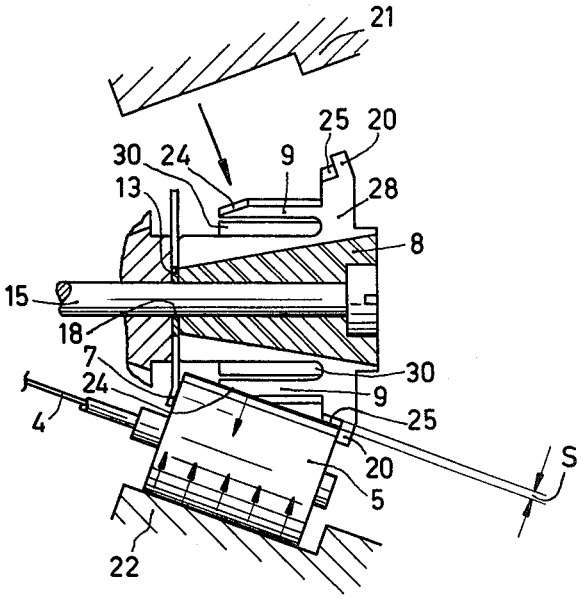
Figure 5:
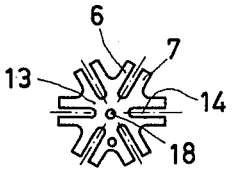

FIG. 1 is a perspective view of a partly disassembled stylus printing head in accordance with the invention, comprising two conical carriers which are arranged one behind the other, FIG. 2 is a longitudinal sectional view of a part of a stylus printing head in accordance with the invention, comprising three consecutively arranged conical carriers, FIG. 3 is a front view of the stylus printing head of FIG. 2, FIG. 4 illustrates the clamping of an electromagnet of a stylus printing head in accordance with the invention, and FIG. 5 shows a star-shaped spring which is used in a stylus printing head in accordance with the invention for locking the electromagnets of one and the same carrier against sliding in their longitudinal direction.

The stylus printing head shown in FIG. 1 comprises a front section 1 (i.e. facing the record carrier during operation) in which there are provided guides for styli 4, and a rear section 2 in which cylindrical electromagnets 5 for operating the styli 4 are grouped around a central axis 10. To this end, the ends of the printing styli 4 which are remote from the ends intended for printing are connected to the armatures of the electromagnets 5. The electromagnets 5 are of the type in which a cylindrical armature is coaxially arranged with respect to a cylindrical excitation coil. The sections 1 and 2 of the printing head are mounted on a mounting plate 3. The front section 1 comprises two locating holes 31 and 32 for positioning the printing head on a carriage.

The rear section 2 comprises two conical carriers 8 which are made of a synthetic material and on which the electromagnets 5 are mounted. The conical carriers 8 are arranged coaxially one behind the other. Their shape actually most resembles that of a truncated cone. The carriers 8 are preferably made of a fiberglass-reinforced thermoplastic synthetic material. For example, polyamide or polycarbonate containing 30% fiberglass is a particularly suitable material. Each of the two carriers 8 shown in FIG. 1 and each of the three carriers 8 shown in FIG. 2 comprises six identical electromagnets 5. The two carriers 8 of the printing head shown in FIG. 1 are identical to the three carriers 8 of the printing head shown in FIG. 2. The number of carriers 8 is dependent of the application of the stylus printing head. Depending on this application, six, twelve or eighteen printing styli are required. The advantages of a modular construction are utilized by keeping the carriers of the printing styli for different applications identical.

For each of the (six) electromagnets, a carrier 8 comprises a support which is in principle formed by two cradle-shaped supporting faces (supports) 24 and 25 at the front and the rear of the carrier 8 (see the FIGS. 2, 3 and 4). Underneath each supporting face 24 there is provided an undercut 30 which extends approximately as far as the relevant supporting face 25. The undercut 30 (in the form of a slot) extends in the axial direction of the conical support 8. Each undercut 30 results in a flexible tongue, the front boundary of which is formed by the supporting face 24. The supporting faces 24 and 25 are bevelled (see the FIGS. 2 and 4) and they are oriented so that in the mounted condition of the printing head, the tongues 9 bear under spring force against the relevant electromagnets 5, the longitudinal axes of the cylindrical electromagnets 5 being situated substantially on one and the same geometrical conical surface. The electromagnets have to be retained in a temporary position before the ultimate mounting by means of a clamping device (21, 22) yet to be described. For the temporary mounting, light clamping takes place between two protrusions which prevent sliding of the electromagnets in their longitudinal direction, but which permit sliding in the radial direction after a given threshold value has been exceeded. After the provisional mounting, the electromagnets 5 occupy the position shown in FIG. 4. Each of the electromagnets 5 is then clamped between a comparatively rigid wall 20 of the cradle-shaped support 25 and two flexible lugs 6 and 7 of a star-shaped metal spring 13 (see FIG. 5) which is common to all electromagnets 5 of one and the same carrier 8. The printing styli 4 can pass through slots 14 in the star-shaped spring 13. In their provisional position, the electromagnets 5 bear against the supporting face 24 of the tongue 9. Between the electromagnets 5 and the supporting face 25 there still exists a clearance S (see FIG. 4). The clearance S is removed only during the ultimate positioning of the electromagnets. The tongues 9 are then bent.

The cradle-shaped supporting faces 24 and 25 are divided by a slot 11 which extends in the longitudinal direction of the relevant electromagnet 5. Moreover, a slot 12 is provided in the carrier 8 between each time two adjacently situated electromagnets. As a result of the undercut 30 and the slots 11 and 12, the cradle-shaped supports 24 and 25 are resilient in a radial as well as in the tangential direction (viewed with respect to the conical carrier 8). After the clamping of all electromagnets in their provisional position between the walls 20 and the lugs 6 and 7, the electromagnets are arranged in their final position. This is realized by means of a clamping device which comprises two halves 21 and 22 (see the FIGS. 1, 2, 3 and 4). Both halves 21 and 22 comprise cradle-shaped bearings 26 for all electromagnets 5. The clamping halves 21 and 22 are preferably made of a metal having favourable thermal conductivity properties. The two clamping halves 21 and 22 are arranged around the electromagnet 5 at the top and the bottom of the printing head and are subsequently interconnected by means of bolts and nuts. To this end, both clamping halves comprise a slot 23, the slot 23 of the clamping half 21 comprising a shoulder 27 which serves as an abutment for a nut (see FIG. 1). For the sake of simplicity, said bolts and nuts are not shown. The clamping halves 21 and 22 are proportioned so that, in the assembled condition, they press the electromagnets 5 (see FIG. 4) against the flexible tongues 9 via the bearings 26. The tongues 9 are thus slightly bent and the clearance S between the electromagnets 5 and the cradle-shaped supporting faces 25 is removed. Because the cradle-shaped supporting faces 24 and 25 are resilient in the tangential as well as in the radial direction, the electromagnets 5 bear against the carrier 8 over an as large as possible area. As a result of the resilience of the supporting faces 24 and 25, this contact is maintained also when the temperature changes.

Each of the conical carriers 8 comprises a centrally situated hole which extends throughout the carrier and wherethrough a bolt 15 can be inserted in order to be screwed into the mounting plate 3. The conical carriers 8 are clamped coaxially one behind the other between the head of the bolt 15 and the mounting plate 3. Between two consecutive carriers 8 there is provided a star-shaped spring 13 which comprises an opening 18 for the passage of the bolt 15. Two consecutive carriers 8 are always rotated with respect to each other so that the slots 11 of the one carrier are situated in the prolongation of the slots 12 in the other carrier. Thus, in the embodiment of a printing head comprising three carriers 8 as shown in FIG. 2, the cradle-shaped supports 24 and 25 of the first and the third carrier are situated in corresponding positions. The printing styli 4 of the electromgnets 5 which are situated on the third carrier 8 extend in the slots 12 of the second carrier 8 and in the slots 11 of the first carrier 8 and are subsequently passed through apertures in the mounting plate 3. The printing styli 4 of the electromagnets 5 which are situated on the second carrier 8 extend in the slots 12 of the first carrier 8. In the embodiment of a printing head comprising two carriers 8 as shown in FIG. 1, the printing styli extend in the same way as in the printing head shown in FIG. 2.

The described printing heads are assembled by first clamping the electromagnets 5 with their printing styli 4 between the relevant wall 20 and the lugs 6 and 7 of the last carrier 8, by inserting the bolt 15 through this last carrier 8, and by subsequently threading the further carriers 8 onto the bolt 15 and providing these carriers with electromagnets 5. After the subsequent mounting of the clamping halves 21 and 22, the printing ends of the printing styli are inserted into the guides of the front section 1 of the printing head, after which the carriers 8, situated on the bolt 15, are moved to the mounting plate 3, the printing styli 4 being slid at the same time in the said guides. Sliding continues until the bolt 15 has been screwed completely into the threaded hole of the mounting plate 3. The carriers 8 are then clamped between the mounting plate 3 and the head of the bolt 15.

We claim:

1. A stylus printing head, comprising cylindrical electromagnets which are circularly arranged around a central axis and which operate the printing styli, said electromagnets being accomodated in cradle-shaped supports of at least one conical carrier, characterized in that the cradle-shaped supports are resilient, that electromagnets being mounted under a substantially radial spring force in the cradle-shaped supports by means of a cover which is common to all electromagnets mounted on the said carrier, each electromagnet being locked against sliding in its longitudinal direction by way of two protrusions, at least one of which is flexible, each of said electromagnets being detachable in its entirety from the cooperating cradle-shaped support by movement in a plane which is perpendicular to the cylinder axis.

2. A stylus printing head as claimed in claim 1, characterized in that the carrier is made of a synthetic material, each of the cradle-shaped supports being divided by a slot which extends in the longitudinal direction of the relevant electromagnet, further slots which extend in the longitudinal direction of the electromagnets, being provided between the cradle-shaped supports of adjacently situated electromagnets.

3. A stylus printing head as claimed in claim 2, characterized in that at the area of each of the electromagnets the carrier comprises an undercut which extends in the longitudinal direction of the electromagnets.

4. A stylus printing head as claimed in claim 2, characterized in that the printing head comprises a number of conical carriers which are arranged one behind the other, two consecutive carriers being arranged to be rotated through such an angle with respect to each other that the slots which divide the cradle-shaped supports of the one conical carrier are situated in the prolongation of the slots between the cradle-shaped supports of adjacently arranged electromagnets of the other conical carrier.

* * * * *